US005901904A

United States Patent [19]

Avôt

[11] Patent Number: 5,901,904

[45] Date of Patent: May 11, 1999

[54] PACKAGE TO BE PROVIDED ON AND AROUND A CONTAINER AND A TOOL AND A METHOD TO DO SO

[75] Inventor: Bernardus Johannes Avôt, The Hague, Netherlands

[73] Assignee: Avot Beheer B.V., The Hague, Netherlands

[21] Appl. No.: 08/727,562

[22] PCT Filed: Apr. 21, 1995

[86] PCT No.: PCT/NL95/00150

§ 371 Date: Feb. 10, 1997

§ 102(e) Date: Feb. 10, 1997

[87] PCT Pub. No.: WO95/29107

PCT Pub. Date: Nov. 2, 1995

[30] Foreign Application Priority Data

Apr. 22, 1994 [NL] Netherlands ..... 9400650

[51] Int. Cl.[6] ..... B65D 85/52

[52] U.S. Cl. ..... 229/109; 47/84; 229/125.27; 493/102; 493/108; 493/114; 493/390

[58] Field of Search ..... 229/23 R, 109, 229/125.27; 206/423; 47/65.7, 84; 493/102–109, 114, 390

[56] References Cited

U.S. PATENT DOCUMENTS

| | | | |
|---|---|---|---|
| 959,098 | 5/1910 | Adams | 229/23 R |
| 3,907,195 | 9/1975 | Struble | 229/128.27 |
| 4,057,444 | 11/1977 | Prot | 493/102 |
| 4,071,064 | 1/1978 | Saul | 206/423 |
| 4,113,093 | 9/1978 | Hendrickx | 206/423 |
| 4,330,059 | 5/1982 | Freeman | 206/423 |
| 4,533,065 | 8/1985 | Chazal et al. | 229/109 |
| 4,628,634 | 12/1986 | Anderson | 47/84 |
| 4,819,862 | 4/1989 | Maroszek | 229/125.27 |
| 5,682,725 | 11/1997 | Weder | 206/423 |

*Primary Examiner*—Gary E. Elkins

*Attorney, Agent, or Firm*—Jacobson, Price, Holman & Stern, PLLC

[57] ABSTRACT

A package to be provided on and around a box-shaped container having a flanged edge, manufactured from a material having resilient properties and an inherent stiffness and including an open tubular element composed of at least three sidewall panels and these connecting corner panels are each provided with a local recess for letting through a part of the flanged edge, the arrangement being such that when a package has been placed on the container, the parts of the flanged edge that extend through a recess project outside the outer circumference of the package at least in the area around that recess. Optionally, such a package can be provided by a tool of tubular form capable of retaining an unfolded package in its interior, which tool with the package secured therein is preferably slid around and on a container from below.

17 Claims, 4 Drawing Sheets

PACKAGE TO BE PROVIDED ON AND AROUND A CONTAINER AND A TOOL AND A METHOD TO DO SO

The invention relates to a package to be provided on and around a box-shaped container having a flanged edge in particular for receiving plants and flowers, which package is manufactured from a material having resilient properties and an inherent stiffness and consisting of a tubular element having an upper edge and a lower edge, which tubular element has a circumferential face formed by panels interconnected by fold lines and is constructed, at least at the lower edge thereof, with an open end, while locking means in the shape of local recesses have been provided near that open end in the panels for letting through a part of the flanged edge and the upper edge has a circumferential dimension suitable for allowing the flanged edge to pass, the arrangement being such that when the package is being provided, the container can be slid into the tubular element from above and when a package has been placed on the container, the parts of the flanged edge that extend through a recess project outside the outer circumference of the package at least in the area around that recess.

Such a package is known from Dutch patent application 9202159. The package disclosed therein is made of a relatively stiff material, the embodiment with the flanged edge portions extending outside the package being intended for substantially round containers. The recesses are provided centrally in the wall panels of the truncated pyramid-shaped package near the narrow open end thereof. The area of the free passage of the package at the location of the recesses is at least equal to the top surface area of the container, so that upon the container being inserted from above, the wall portions can deform resiliently to allow the container to pass until flanged edge portions can reach through the recesses and the package can spring back into its starting position. This requires the use of relatively stiff material and a substantially round shape of the container.

A package for a rectangular container is known from U.S. Pat. No. 2,830,405. Here, however, the container cannot be slid into the package from above but is to be formed around the container. This is a rather labor-intensive method which, when packaging, for instance, plants and flowers, may moreover give rise to damage of those articles, which will hardly ever happen when a container with plants and flowers is being lowered into the package.

The object of the invention is to render a package of the type referred to in the preamble suitable for application to a substantially rectangular container while maintaining a rapid, simple packaging method entailing little chance of damage to the products to be packaged.

This is achieved, in accordance with the invention, if the tubular element is composed of at least three sidewall panels connected in pairs, at least over a part of their height starting from the lower edge, by corner panels, and at least each corner panel is provided with a local recess, while, viewed in circumferential direction of the tubular element, at least two of three successive fold lines between sidewall panels and corner panels, which lines extend in height direction of the tubular element, are not parallel. By these measures a package is obtained which can be reliably secured to a box-shaped container by lowering the box-shaped container from above into the package, whereby the flanged edge of the box-shaped container, as of a particular moment, deforms at least the corner panels in outward direction until flanged edge portions end up in the recesses. At that moment the corner panels spring back into their starting position and the package is snapped securely on the box-shaped container.

It goes without saying that the package in the area above the recesses should be dimensioned such that the box-shaped container can be slid through the package. If a relatively stiff material is involved, then it is preferred that the inner circumference of the package just above the recesses is greater than the outer circumference of the flanged edge of the box-shaped container. When working with less stiff material allowing a possibly minor degree of stretch, then it is even possible to opt for an inner circumference of the package just above the recesses which is smaller than the outer circumference of the flanged edge of the box-shaped container. It will need no further explanation that in the latter case, after the rebound of the initially stretched corner panels, a reliable securement of the package onto the box-shaped container is obtained. However, also in the former case such a locking securement is ensured because in fact all of the corner panels having sprung back into their straight position must be bent outwardly simultaneously in order for the flanged edge portions locked in the recesses to be released from those recesses.

As will appear from the foregoing, thus a package has been obtained which can not only be fitted to polygonal box-shaped containers, in addition to round ones, but also, if desired, can be manufactured from fairly light material.

In its operative position the package according to the invention should therefore have a shape such that a box-shaped container can be slid into the tubular element from above and is locked relative to the tubular element adjacent the lower end thereof. To realize this effect, a preference is expressed for the corner panels to have a trapezoidal shape. The sidewall panels can then have any other suitable form, such as for instance a rectangle. However, if the aim is for the wall of the tubular element to be brought as much as possible into vertical alignment with the box-shaped container, so that adjacent box-shaped containers can be placed against each other or virtually against each other, then it is preferred that the sidewall panels and the corner panels have the shape of a trapezium which may or may not be isosceles, and in particular that, viewed in the direction of the open end, the sidewall panels have a narrowing and the corner panels a widening trapezoidal shape. Thus it is even possible to give the tubular element a circumferential dimension which is the same throughout its height. The box-shaped container can then be slid into the tubular element from above, during which displacement the panels are bent outwardly virtually in conformity with the outer circumference of the flanged edge of the box-shaped container until the recesses are reached, whereafter the corner panels rebound into a flat configuration above the box-shaped container and thus secure the package to the container. Sliding the box-shaped container into the tubular element from above in this manner is particularly advantageous if the box-shaped container is used for transporting flowers or plants, accommodated in pots or not, which typically have an upwardly diverging form, i.e. outwardly overhanging portions. If these overhanging portions are approached from below and pushed towards each other, the plants or flowers can thus be compacted without being damaged.

If a number of box-shaped containers with the package provided thereon are to be handled simultaneously, for instance for the purpose of storage or transport, it is preferred, in accordance with a further elaboration of the invention, that the sidewall panels have a triangular shape which may or may not be isosceles and/or identical. If then two angular points of the triangular shape are situated at the lower edge and the third angular point is situated on an upper edge of the tubular element located opposite the lower edge, the tubular element acquires a rectangular upper edge whose corner points, when a rectangular box-shaped container is used, are situated above the corner points of that container. If the dimensions and configuration of the circumference of the upper edge of the tubular element are tailored to those of the flanged edge of the box-shaped container, a number of box-shaped containers with the packaged provided thereon can be placed against each other without interspaces.

In the latter case, the package has, as it were, a straight tubular form, which, when packages are being fitted rapidly, for instance mechanically, might give rise to a situation where the upper edge moving upwards relative to the plants or flowers acts as a kind of knife and thereby might cause damage. In those cases it is preferred that, starting from an upper edge of the tubular element located opposite the lower edge a number of cuts are provided near the corner points, the arrangement being such that the tubular element has outwardly bendable upper edge areas and can temporarily assume a funnel-shaped configuration there. Depending on the configuration of the tubular element, the cuts can follow a fold line or be provided in a corner panel.

As mentioned, a box-shaped container is to be slid from above into a package until flanged edge portions engage the recesses of the tubular element. To enable this to be effected in a rapid and relatively simple manner, the invention further relates to a tool comprising a tubular mold that is open at at least one end thereof and comprises a number of wall parts corresponding to the number of sidewall panels of the package to be provided and dimensioned to enable the sidewall panels of a package that is in its inserting position to abut at least partly against the inner surfaces of the wall parts, means being present for realizing, maintaining and removing again said abutting. Thus with the aid of the tool the package can be rapidly and simply brought into, and maintained in, its open, receiving position. If the package is retained in the tool, for instance by means of reduced-pressure means, a retaining force can be realized which is relatively large but can be distributed over the entire surface of the tubular element, so that even if the tubular element is made of relatively weak material, such as paper, the risk that the tubular element is torn during its application will hardly, if ever, occur. Also, in that way the required force can be effectively produced in the case where the tubular element is to stretch slightly to allow the flanged edge portions to enter the recesses. In this way a package can be extremely reliably and very rapidly applied to a box-shaped container.

With reference to the exemplary embodiments shown in the drawings, the package according to the invention and the tool for placing such package on a box-shaped container will now be further described and explained. In these drawings.

Figure 5:
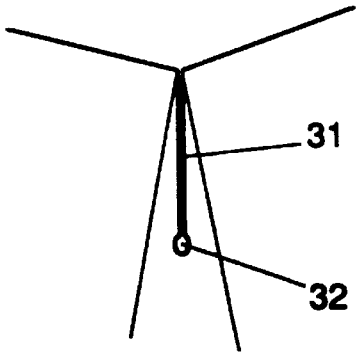
Figure 6:
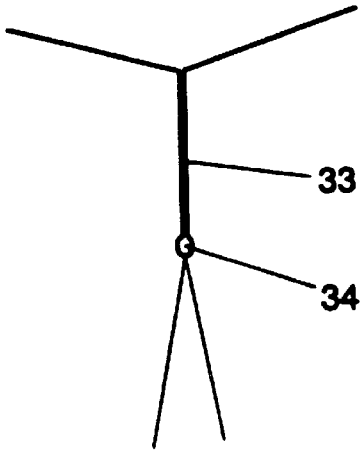

FIGS. 5 and 6 each show a possible structural detail; and

Figure 2:
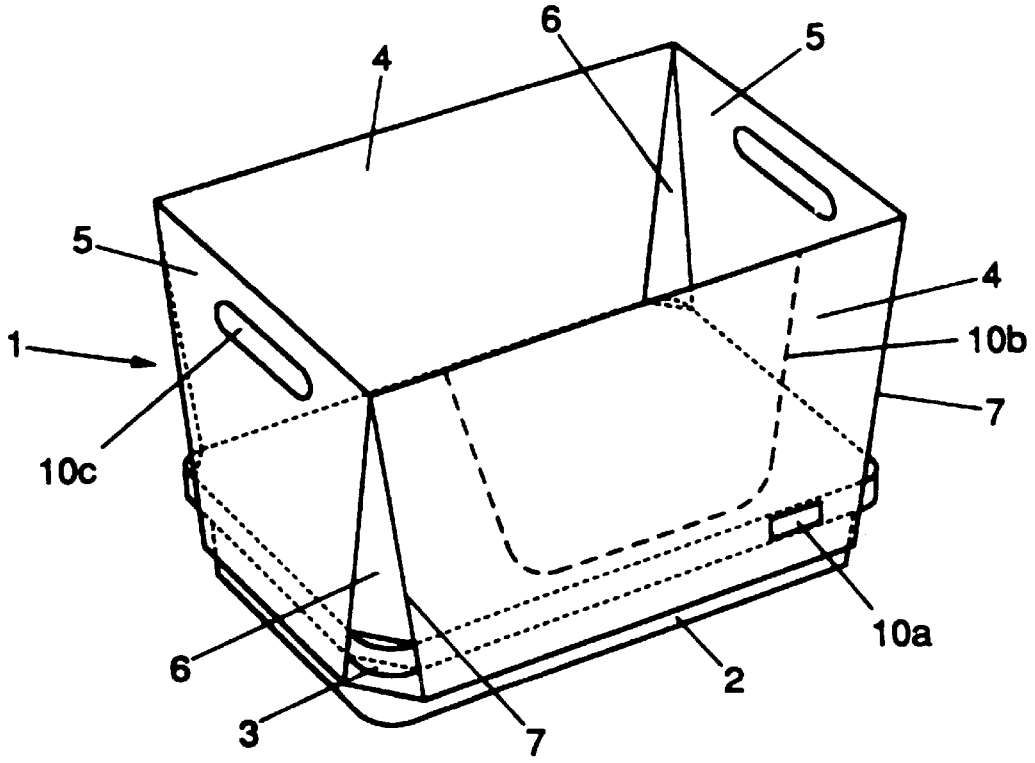
FIG. 2 is a perspective view of the package according to FIG. 1 placed on a box-shaped container.
Figure 7:
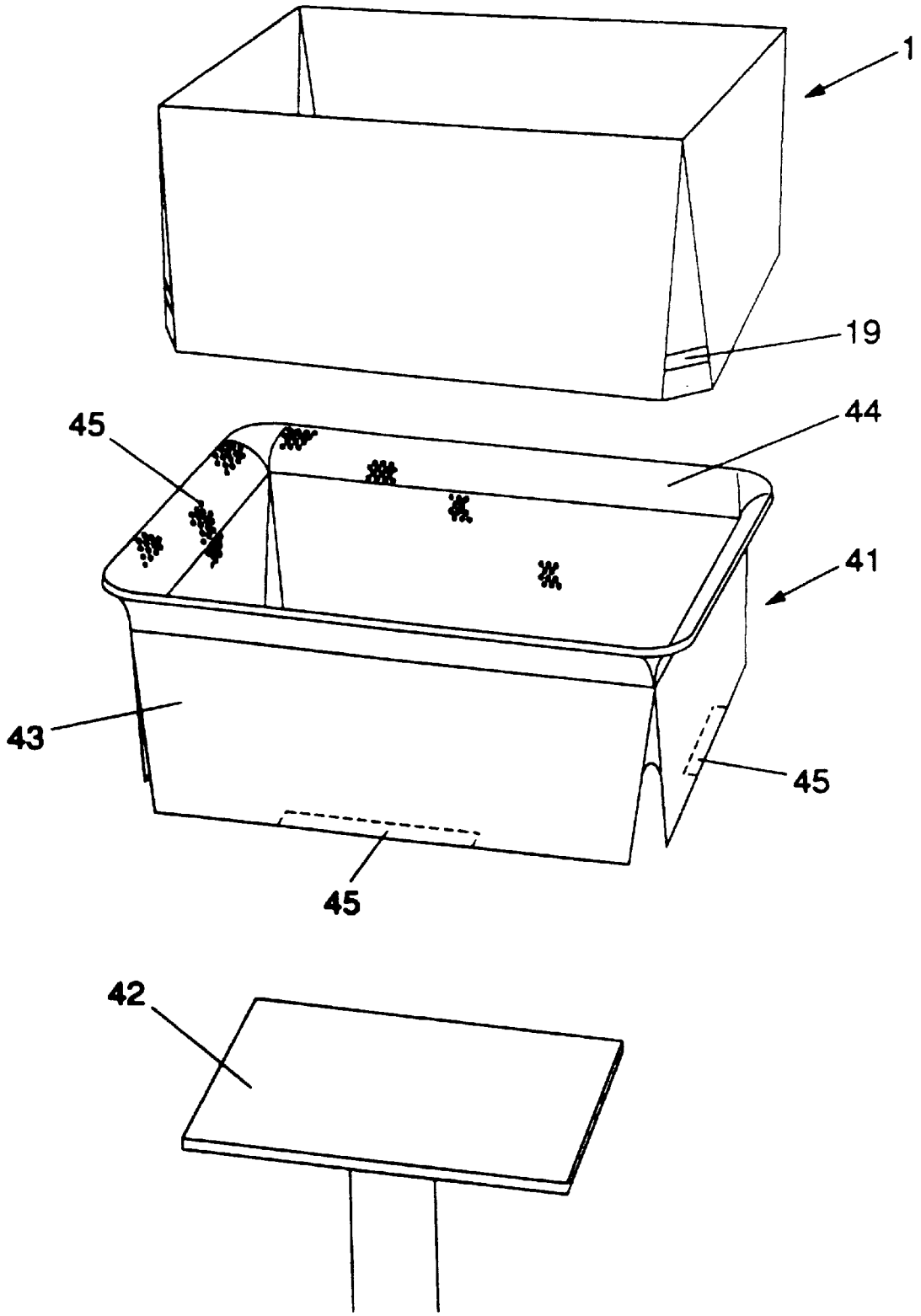

FIG. 7 shows, in an extremely diagrammatical manner, an apparatus for providing a package according to FIG. 2 on and around a box-shaped container.

Figure 1:
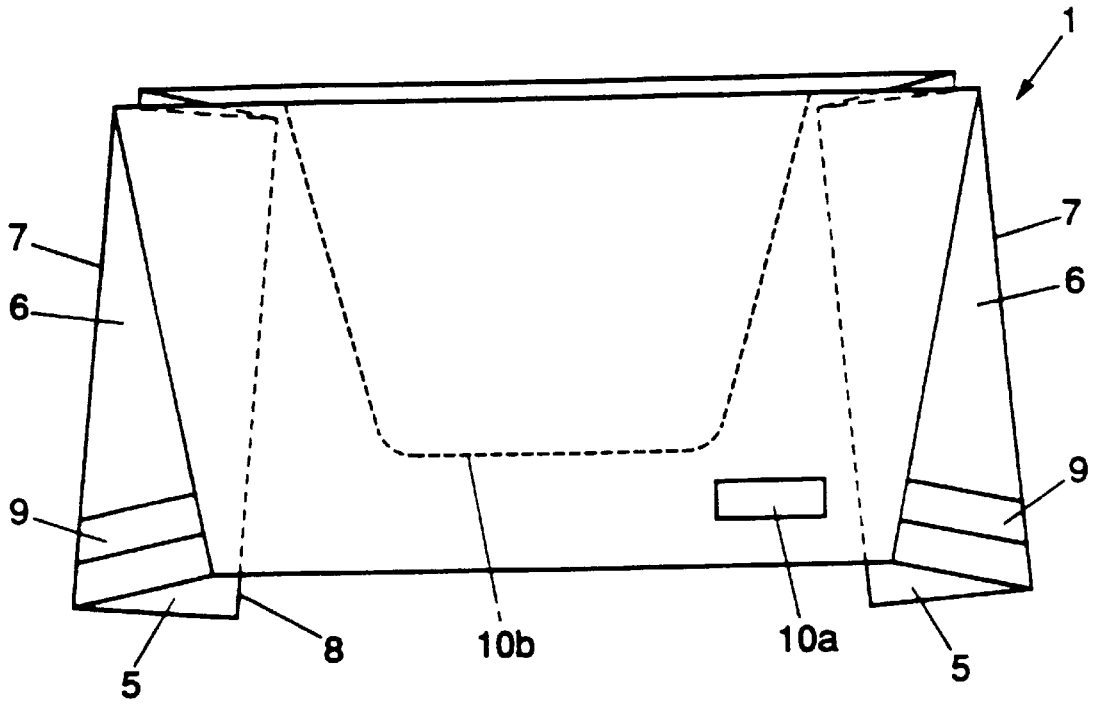
FIG. 1 is a side elevation of a first embodiment of the package according to the invention in collapsed condition.

FIGS. 1 and 2 show a package 1 intended to be placed on a box-shaped container 2 having a flanged edge 3 with rounded corners. The package 1 comprises two opposite, identical sidewall panels 4 and two smaller, likewise opposite, identical sidewall panels 5. The sidewall panels all have the shape of an isosceles trapezium and are interconnected by four identical corner panels 6, which all have the shape of an isosceles triangle and are connected with the adjoining sidewall panels by means of fold lines 7. To enable the package to be brought into the flat storage and transport position shown in FIG. 1, the sidewall panels 5 are centrally provided with an additional fold line B. The corner panels 5 are further provided with recesses 9, extending paralallel to the base of the triangular panel throughout the width thereof and having a height that corresponds to that of the flanged edge 3. In the sidewall panels various other provisions can further be made, such as a recess 10*a* for enabling reading a bar code provided on the container 2 and an inspection and display flap with tearing perforation 10*b* for enabling lateral inspection of the packed articles, for instance plants or flowers, and two handgrip openings 10*c* in the sidewall panels 5.

As appears from FIG. 2, the box-shaped container 2 has been slid into the package 1 so that the corner parts of the flanged edge 3 extend through the recesses 9. By providing the corner panels 6 between the sidewall panels 4 and 5, the package has an octagonal cross-section at the level of the flanged edge 3, while due to the presence of the recesses 9, the corner panels 6 can as it were cut off the corner areas of the flanged edge 3, resulting in a reliable locking of the package 1 on the box-shaped container 2. The manner, and in particular the mechanical manner, in which the connection between container and package can be realized will further be returned to hereinafter.

Figure 3:
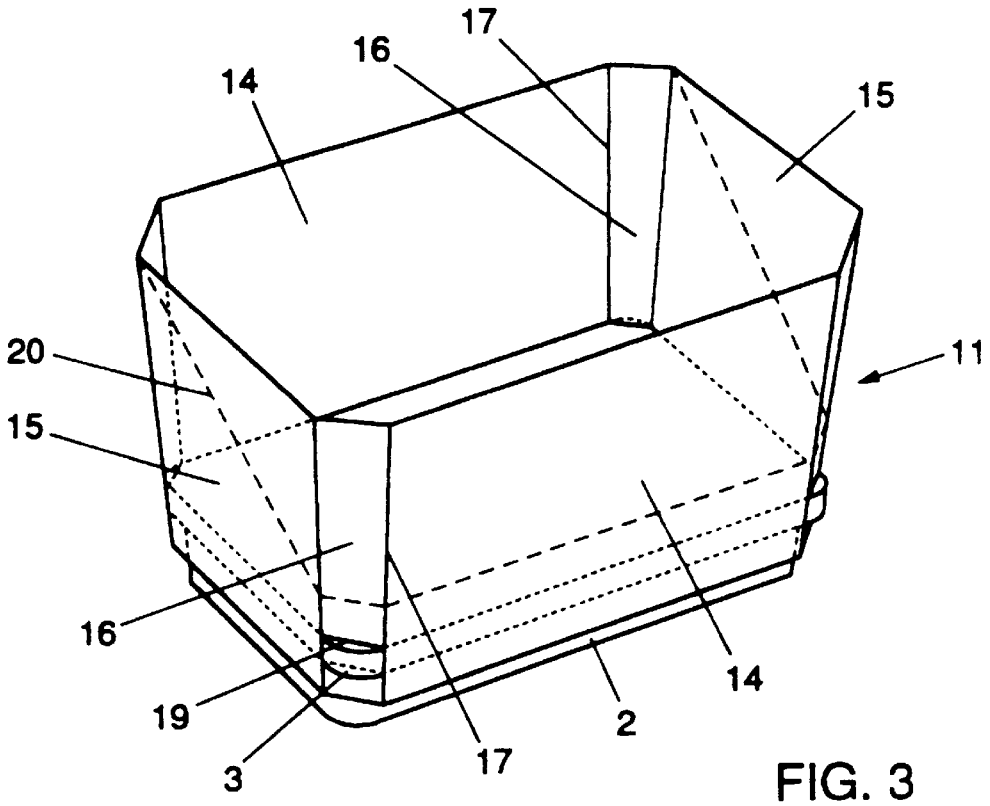
FIG. 3 is a perspective view of a second embodiment of the package according to the invention placed on a box-shaped container.

FIG. 3 shows a package 11 comprising, in the manner of FIG. 1, two large sidewall panels 14 and two small sidewall panels 15, all having the shape of an isosceles trapezium again. By means of fold lines 17, the sidewall panels 14 and 15 are all connected on two sides with a corner panel 16. Like the sidewall panels, the mutually equal corner panels 16 all have the shape of an isosceles trapezium. The corner panels 1 further all comprise a recess 19, extending throughout the width of a corner panel parallel to the base thereof and having a height corresponding to that of the flanged edge 3.

Because the sidewall panels 14 and 15 as well as the corner panels 16 have an upwardly widening trapezoidal shape, a package 11 is obtained that diverges from the box-shaped container. In the package 1 according to FIG. 2, the triangular corner panels 6 taper in upward direction. In this configuration, the various dimensions of the package 1 can be chosen such that the upper edges of the package 1 are located virtually directly above the outer edge of the flanged edge 3, allowing a number of box-shaped containers 2 to be disposed side by side with the packages 1 being in mutual contact. A further difference between the packages 1 and 11 resides in the shape of the upper edge, which in package 1 is rectangular and in package 11 octagonal.

The two sidewall panels 15 are further provided with a tear line 20 which, viewed in FIG. 3, extends diagonally across the panel from the rear top corner point and, in the front corner panel 16, continues on the corner panel 16 at some distance above the flanged edge 3 and on the front sidewall panel 14 parallel to the flanged edge 3. By means of this tear line 20, a part of the package 11 can be removed, whereby at a sales outlet, the articles contained in the box-shaped container 2 can be brought into an attractive display position without any further operations.

Figure 4:
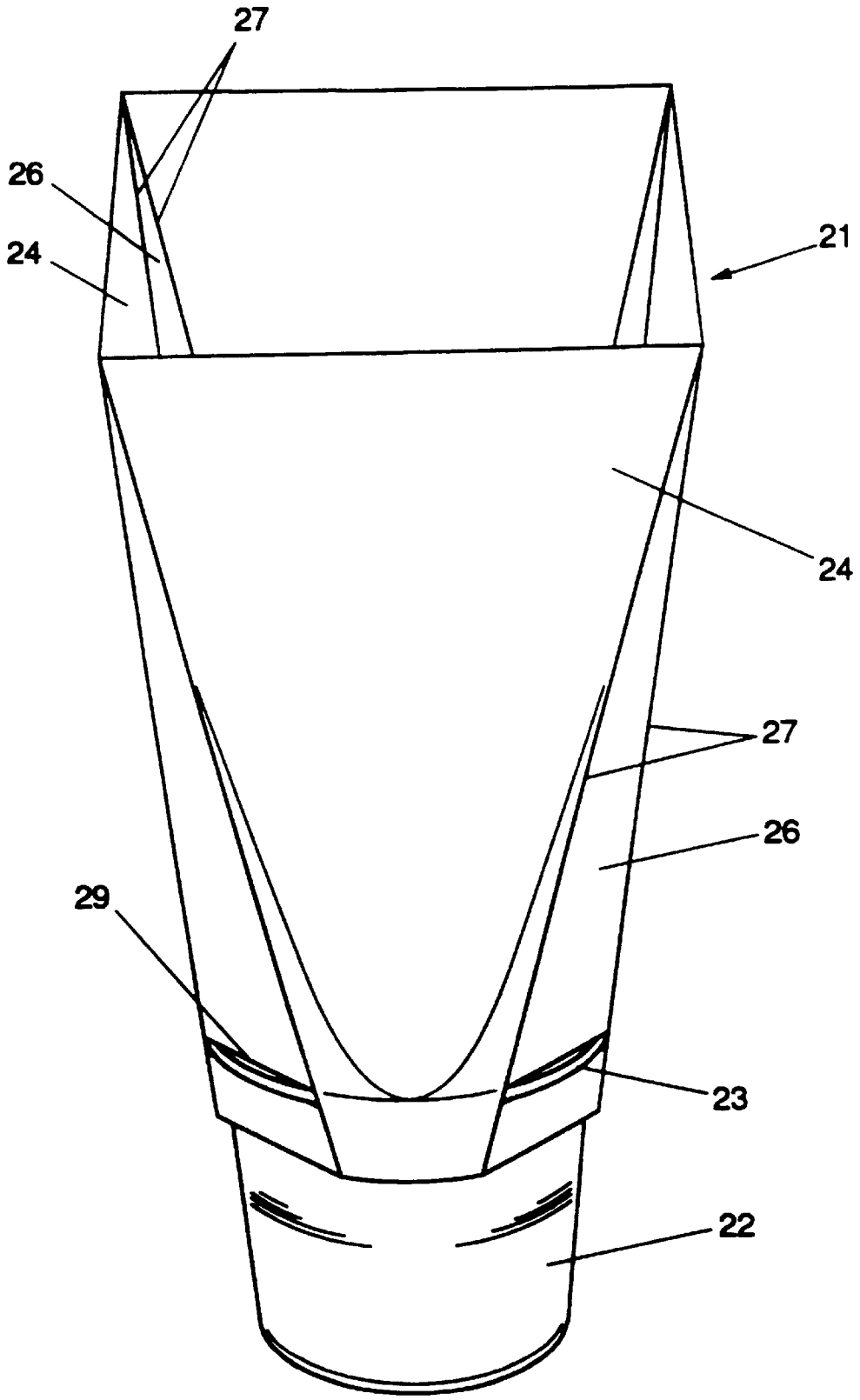
FIG. 4 is a perspective view of a third embodiment of the package according to the invention placed on a box-shaped container.

FIG. 4 shows a package 21 intended for being provided on a round box-shaped container 22 having a flanged edge 23. The package 21 is composed of four identical wall panels 24 having the shape of an isosceles trapezium, which wall panels 24 are mutually connected by four identical corner panels 26 having the shape of an isosceles triangle, with the various panels connecting to each other by means of fold lines 27. The corner panels 26 are each provided with a recess 29 for letting through a part of the flanged edge 23.

Hereinabove it is observed that the inner circumference of the upper edge area of a package can be approximately equal to the outer circumference of the flanged edge. For providing a package on a container, the latter should be slid from above into an opened package until flanged edge portions snap into the recesses. If the outer circumference of the flanged edge has approximately the same dimension as the inner circumference of the upper edge of the package, this may give rise to laborious inserting operations. In that case, it may be preferred that the package is provided with a cut in at least one of its corner points, starting from the upper edge. FIGS. 5 and 6 give examples of such an embodiment. For instance, in FIG. 5 a cut 31 is provided extending according to a perpendical in a triangular corner panel and ending in a puch hole 32 to minimize the risk of tearing further. FIG. 6 shows an embodiment wherein the sidewall panels have been extended above the top corner point of a corner panel and are separated from each other over that extended part by a cut 33 ending in a punch hole 34. It is obvious that such a cut can be present at each corner point and that it can be provided in a corner panel in a way other than centrally. For instance, a cut may follow a fold line between a corner panel and a sidewall panel. In addition, such a cut, optionally ending in a punch hole, may be provided so as to extend in upward direction from the upper edge of a recess 9, 19 or 29. Such a cut is particularly preferred when a package is manufactured from a relatively stiff, resilient material. When the corner parts of the flanged edge of the container are forced into the package, a limited outward bending is possible that is directly released when a corner part ends up in the recess.

FIG. 7 shows a tool 41 and a supporting face 42, capable of upward and downward movement in a manner not further shown. The tool 41 has the shape of a double-walled tubular element 43, open at the two ends, whose part 43 has an inner circumference dimensioned so as to be capable of receiving a package, in its inserting position, to be provided on a box-shaped container. Hereinabove, the package 1 shown in FIG. 7 is further described with reference to FIGS. 1 and 2, that package moreover being provided, on each corner point, with a cut 31 according to FIG. 5. The tool 41 further has an outwardly bent upper edge area 44, provided, in the area that is in line with the inner walls of the double-walled part 43, with a large number of bores 45. Similar bores are present in the inside wall of the double-walled part 43. The inner space of the double-walled tool 41 is connected, in a manner not further shown, with a vacuum source. Provided at the lower edges of the part 43 are stop shoulders 45.

For providing the package 1 on the box-shaped container 2 that is not shown in FIG. 7 but is shown in FIG. 2, the procedure is as follows.

In a position as shown in FIG. 7, wherein the tool 41 is located above the supporting face 42, the package 1 is disposed in unfolded position in the tool 41, while a suction generated by means of the bores 45 causes the sidewall panels to abut against the inside walls of the tool and the stop shoulders 45 prevent the package 1 from being completely or partly pulled through the tool 41. Due to the cuts 31 present in the package 1, in conformity with FIG. 5, the upper edge areas of the package, bent into the shape of a funnel, will be sucked against the upper edge area 44 of the tool 41, allowing an insertion from above of a box-shaped container to take place smoothly and without problems, even if the circumferential dimension of the upper edge of the package hardly differs from that of the flanged edge of the box-shaped container.

After a package 1 has thus been accommodated in the tool 41, the supporting face 42 is moved upward through the tool 41 to reach a position above that tool. Subsequently, a box-shaped container with contents to be packed is placed on the supporting face 42 in a centred position relative to the tool and the assembly of tool 41 and package 1 is moved upward until the flanged edge corners of the box-shaped container engage with the recesses 19 in the manner as shown in FIG. 2. Should the danger occur that a force is exceeded by a particular value when the package is thus pulled on and around the container, the container can be prevented from coming loose from the supporting face with means not further shown.

Pulling the package on and around the container in such manner has advantages in particular if the articles received in the box-shaped container are plants or flowers that project outside that container. When the tool containing the package, bent at its upper end so as to be funnel-shaped, is moved upward, the projecting flowers and plants are approached from below. As is known, plants and flowers can thus be compressed into a more compact mass with the smallest risk of damage. In this manner, the projecting flowers or plants can be accommodated in a package that hardly projects from the box-shaped container, if at all, without any problems. This compression effect can be further promoted if the outwardly bent outer edge area 44 is formed, in a manner not shown, by rotating rollers which guide parts of the products that project outside the container, for instance leaves of plants, inwards, preventing them from being damaged even when they are processed very rapidly.

If one of the sidewalls of the part 43 is at least partly left out, it is possible to supply a package, in collapsed position, from aside and fold it open after having been slid into the tool 41. In this connection, it is then preferred that the panels 5, folded inwards in FIG. 1, are folded outwards, causing the fold line 8 to be the part of the package that extends furthest to the left or to the right. When inserted laterally, the fold line 8 strikes an opposite wall 43, whereupon, promoted by the suction action, the package reaches its unfolded position and is ready for receiving a container.

When the tool 41 is brought downward again to reach the position shown in FIG. 7, the package 1 is left in its position locked on the container, partly due to the vacuum source having been switched off, while the upper wall parts of the package, initially bent outwards, spring back again into a straighter position, in line with the other part of the package. After having been disconnected, if required, the box-shaped container with the package provided thereon is taken from the supporting face 42, optionally mechanically, whereupon the supporting face 42 is brought to its starting position again, through the tool 41, and the package-providing cycle has been completed.

It is obvious that within the scope of the invention as laid down in the appending claims many further modifications and variants are possible. For instance, the sidewall panels need not all or in pairs be identical, while shapes other than isosceles trapezia are also possible, such as for instance rectangles. Further, instead of straightly horizontal, the upper and lower edges can have any desired shape, for instance from an aesthetic viewpoint. Discussed is a package that widens in upward direction or a straight package.

Through a suitable use of cuts such as for instance shown in FIGS. 5 and 6, and a certain elasticity of the packing material, a shaped tapering in upward direction can also be realized. If the package becomes wider in upward direction, the provision of cuts can in many cases be abandoned. In such case, the upper edge area of a tool for providing such package will not have an additionally bent shape, but a shape that corresponds to that of the unfolded package. The means for securing a package in the tool have been described as a vacuum source capable of exerting a suction action on the package by means of bores in the double-walled tool. Of course, for obtaining the desired retaining effect other suitable means can be used as well, in which connection means for pulling the package home electrostatically may for instance be thought of. Hereinabove, rectangular and round box-shaped containers have been discussed. It will be understood that the invention is also applicable to differently shaped containers, for instance to containers having three or more than four corners or having an oval shape.

I claim:

1. A package to be provided on and around a container having a bottom and at least one sidewall ending in a flanged edge and being suited for receiving plant and flowers, said package being manufactured from a material having resilient properties and an inherent stiffness and consisting of a tubular element having an upper edge and a lower edge, said tubular element having a circumferential face formed by panels interconnected by fold lines and being constructed, at least at the lower edge thereof, with an open end, while locking means configured by local recesses have been provided near said open end in the panels for letting through a part of the flanged edge and the tubular member starting from the upper edge has a circumferential dimension suitable for allowing the flanged edge to pass, such that the container can be slid into the tubular element from above until at least one part of the flanged edge extends through one of said local recesses wherein the tubular element is composed of at least three sidewall panels each having a height and being connected in pairs, at least over a part of their height starting from the lower edge, by corner panels, each corner panel being connected to adjacent sidewall panels by fold lines and at least each corner panel being provided with one of said local recesses, while, viewed in circumferential direction of the tubular element, at least two of three successive fold lines between sidewall panels and corner panels, which lines extend in height direction of the tubular element, are not parallel.

2. A package according to claim 1, wherein the corner panels have a trapezoidal shape.

3. A package according to claim 1, wherein the sidewall panels and the corner panels have a trapezoidal shape.

4. A package according to claim 2, wherein each trapezoidal panel has the shape of an isosceles trapezium.

5. A package according to claim 3, wherein viewed from the upper edge to the lower edge, the sidewall panels have a narrowing and the corner panels have a widening trapezoidal shape.

6. A package according to claim 1, wherein the sidewall panels have a triangular shape.

7. A package according to claim 6, wherein two angular points of the triangular shape are situated at the lower edge and the third angular point is situated at an upper edge of the tubular element located opposite the lower edge.

8. A package according to claim 6, wherein each triangular panel is configured as an isosceles triangle.

9. A package according to claim 1, wherein the corner panels connecting the at least three sidewall panels are identical.

10. A package according to claim 1, wherein starting from the upper edge towards the lower edge, a number of cuts have been provided such that the tubular element has outwardly bendable upper edge areas and can temporarily assume a funnel-shaped configuration by outwardly bending said upper edge areas.

11. A package according to claim 10, wherein at least one of said cuts follows one of said fold lines between the sidewall panels and the corner panels.

12. A package according to claim 10, wherein at least one of said cuts has been provided in one of said corner panels.

13. A tool for for bringing a package in an inserting position for receiving a container having a bottom and at least one side wall ending in a flanged edge, said package being manufactured from a material having resilient properties and an inherent stiffness and consisting of a tubular element having an upper edge and a lower edge and being composed of a number of at least three sidewall panels, each two adjacent sidewall panels being connected by a corner panel, each corner panel being connected to adjacent sidewall panels by fold lines, said tubular element being provided with locking means configured by local recesses near the lower edge, each local recess allowing a part of the flanged edge to pass, said tool comprising a tubular mold that has an upper open end and a lower open end and comprises a number of wall parts corresponding to the number of sidewall panels of the package and dimensioned to enable the sidewall panels of the package in its inserting position inside the tubular mold abutting at least partly against the wall parts, means being present for realizing, maintaining and removing again said abutting.

14. A tool according to claim 13, wherein said abutting is provided by vacuum means.

15. A tool according to claim 13, wherein the tubular mold has a free passage at the lower open end that is adjusted to the lower edge of the package in its inserting position, and has at the upper open end an area ending in a funnel-shaped manner, while at least in said area said means for realizing, maintaining and removing again said abutting are present.

16. A method for connecting a package and a container having a bottom and at least one sidewall ending in a flanged edge, said package being manufactured from a material having resilient properties and an inherent stiffness and consisting of a tubular element having an upper edge and a lower edge and being composed of a number of at least three sidewall panels, each two adjacent sidewall panels being connected by a corner panel, each corner panel being connected to adjacent sidewall panels by fold lines, said tubular element being provided with locking means configured by local recesses near the lower edge, each local recess allowing a part of the flanged edge to pass, said package being brought into an inserting position by utilizing a tool comprising a tubular mold that has an upper open end and a lower open end and comprises a number of wall parts corresponding to the number of sidewall panels of the package and dimensioned to enable the sidewall panels of the package in its inserting position inside the tubular mold abutting at least partly against the wall parts, means being present for realizing, maintaining and removing again said abutting, said method comprising the steps of bringing the package in the tool in the container on a supporting face located in alignment above the tool with package, bringing the container into the the tool with package by displacing the supporting face and the tool with package relative to each other until parts of the flanged edge pass into and through the local recesses of the package, and subsequently removing the container with the package locked thereon from the tool by displacing the supporting face and the tool relative to each other.

17. A method according to claim 16, wherein after the package has been brought into the inserting position in the tool, the supporting face is moved upward through the tool with package to reach a position above the tool with package, and subsequently the container is placed on the supporting face, the tool with package is slid upward around the container until the package has been locked on the container, the tool is displaced to below the supporting face, the container with the package locked thereon is removed from the supporting face and said supporting face is displaced to below the tool again.

* * * * *